United States Patent [19]

Vest

[11] 4,092,706

[45] May 30, 1978

[54] PORTABLE FLUORESCENT LIGHT

[76] Inventor: Gary W. Vest, 4483 Broadview Rd., Cleveland, Ohio 44109

[21] Appl. No.: 759,423

[22] Filed: Jan. 14, 1977

[51] Int. Cl.[2] ..... F21V 15/04; H01R 33/12

[52] U.S. Cl. ..... 362/390; 339/56; 362/138; 362/223; 362/263; 362/369

[58] Field of Search ..... 240/51.11 R, 51.11 A, 240/11.4 R, 11.4 N, 2.18, 90, 52 R, 153, 54 R; 339/56; 248/358 AA

[56] References Cited

U.S. PATENT DOCUMENTS

| | | | |
|---|---|---|---|
| 1,903,127 | 3/1933 | O'Rourke | 240/52 R |
| 2,752,480 | 6/1956 | Priebe | 240/90 |
| 3,136,489 | 6/1964 | Oharenko | 240/90 |
| 3,140,054 | 7/1964 | Oharenko | 240/2.18 |
| 3,210,533 | 10/1965 | Mappes | 240/90 |
| 3,283,144 | 11/1966 | Rogers | 240/51.11 |
| 3,435,206 | 3/1969 | Swanson | 240/51.11 R |
| 3,555,268 | 1/1971 | Zurawski | 240/51.11 R |
| 3,719,820 | 3/1973 | Yarmark | 240/153 |
| 3,767,904 | 10/1973 | Cook | 240/11.4 R |
| 3,947,678 | 3/1976 | Tang | 240/11.4 R |

*Primary Examiner*—Samuel W. Engle

*Assistant Examiner*—Donald P. Walsh

*Attorney, Agent, or Firm*—Bosworth, Sessions & McCoy

[57] ABSTRACT

A portable fluorescent light utilizing a fluorescent tube mounted in an elongated transparent tubular plastic housing with protective end caps. A power cord with associated ballast is used to connect the unit to a power source. Sockets for the fluorescent lamp are mounted on special socket supports inserted in each end of the housing. The socket supports are each in the form of an elongated metal strip bent into a four-legged generally rectangular shape. Two parallel side legs are connected by screws to the tubular housing and the inner leg, which is connected to only one of the side legs, carries its respective socket and is adapted to flex about one end between a relaxed inwardly extending position and a flexed operating position generally perpendicular to the side legs in order to apply an advantageous endwise holding force to tightly retain the fluorescent lamp between the two sockets and also to accommodate thermal expansion and contraction of the tubular plastic housing to which the socket supports are mounted caused by heat from the lamp and environmental temperature variations.

1 Claim, 4 Drawing Figures

PORTABLE FLUORESCENT LIGHT

BACKGROUND OF THE INVENTION

This invention relates to portable lights, such as safety inspection lights or "trouble" lights, and especially to the type of portable light that utilizes a fluorescent lamp rather than an incondescent bulb. More particularly, the invention relates to an improvement in portable fluorescent light units to facilitate the mounting of the lamp sockets in the unit and also to enable the unit to better accommodate thermal expansion and contraction of the housing to which the socket supports are attached and which thereby establishes the spacing between the two respective sockets.

Portable fluorescent lights have many advantages compared with other types of "trouble" lights, etc., and they are used to particular advantage in garages where automotive service is performed, as well as in otherwise unlighted areas, such as attics, that are used infrequently. Prior art units of this type generally utilize a tubular transparent plastic housing of fairly sturdy construction and a fluorescent lamp, such as a 15 watt, 17-inch lamp, is inserted, together with the necessary sockets and a switch associated with the electrical circuit. A ballast is provided on the power cord, the power cord usually being sufficiently long to enable the light to be carried around a relatively large area.

One difficulty encountered in the assembly of this type of light concerns the attachment of the fluorescent lamp sockets to the transparent tubular plastic housing. Typical prior art constructions are shown in U.S. Pat. Nos. 3,136,489, 3,140,054 and 3,242,331.

It is desirable and important that the fluorescent lamp be held snugly between the sockets and that the same means for holding the lamp being able to accommodate thermal expansion and contraction of the housing to which the socket supports are mounted that can normally be expected.

The construction of the present invention resolves the difficulties indicated above and affords other features and advantages heretofore not obtainable.

SUMMARY OF THE INVENTION

It is among the objects of the invention to simplify the assembly of portable fluorescent light units of the type described. p Another object is to provide means in a portable fluorescent light unit to accommodate thermal expansion and contraction that may occur due to the heat generated by the lamp and due to environmental temperature changes.

These and other objects and advantages are achieved by the novel portable fluorescent light construction of the invention wherein the unit is provided with a fluorescent lamp and sockets supported therein and electrical circuit means including a switch and power cord for connecting the unit to a power source.

In accordance with the invention, a pair of novel socket supports are provided, one being inserted in each end of the transparent tubular housing, and each support being formed of an elongated strip of resilient metal bent into a four-legged, generally rectangular form with two parallel side legs connected by screws to the tubular housing, an outer leg connecting the two side legs and a flexible resilient inner leg on which the respective socket is mounted. The inner leg is connected to only one of the side legs and is adapted to flex about its connection point between a relaxed inwardly extending position and a flexed operating position generally perpendicular to the side legs. When the sockets and their supports are assembled with the lamp, and the assembly inserted in the tube, the inner legs are flexed to their operating position to apply, when the supports are attached by screws to the housing, a tight holding force to the lamp. Also the inner legs are able to flex to accommodate thermal expansion and contraction of the housing to which the socket supports are attached caused by heat generated by the lamp and due to environmental temperature changes.

DESCRIPTION OF THE PREFERRED EMBODIMENT

Figure 2:
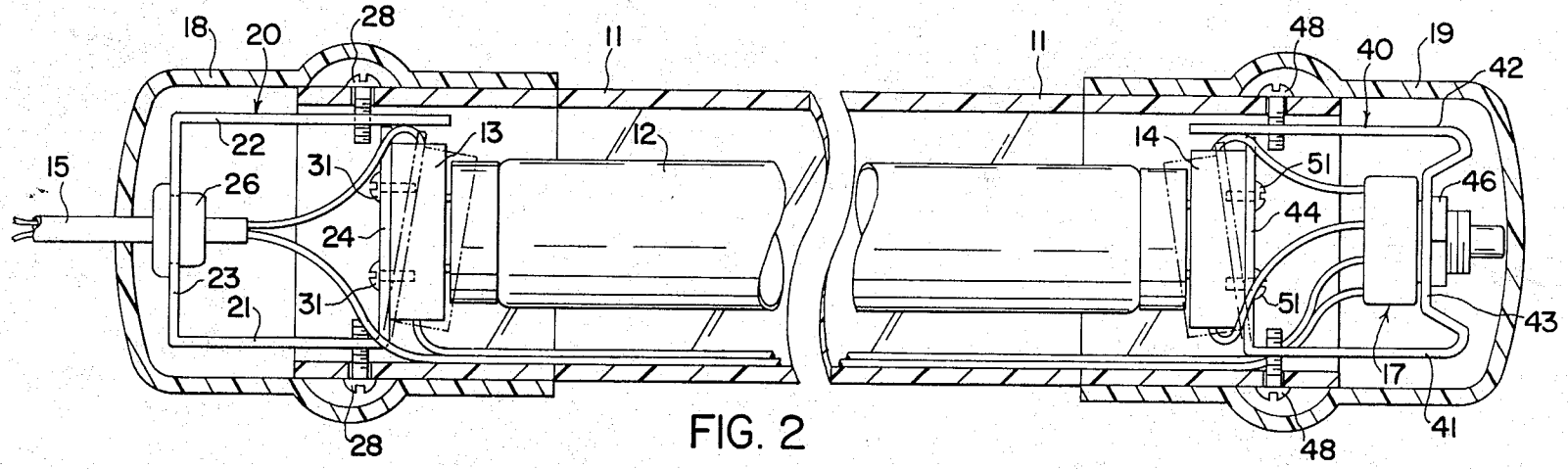
FIG. 2 is a sectional view on an enlarged scale taken on the line 2—2 of FIG. 1.
Figure 1:
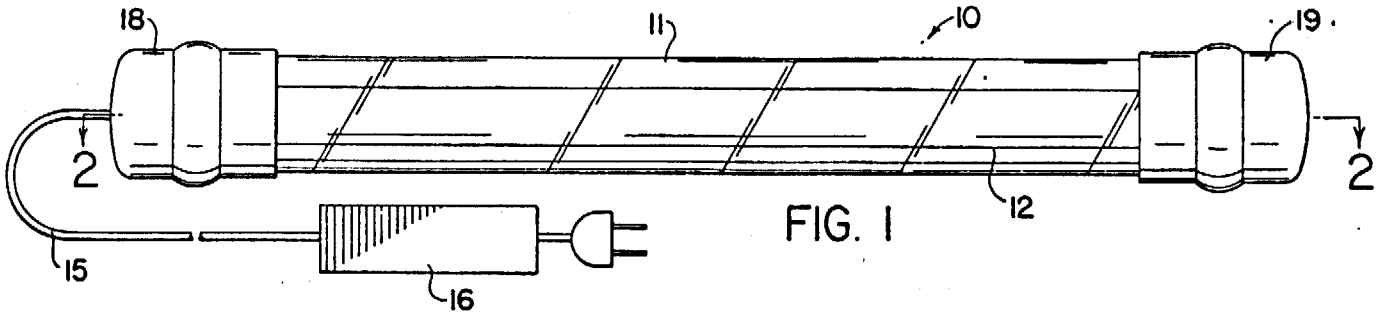
FIG. 1 is an elevational view illustrating a portable fluorescent light constructed in accordance with the invention.
Figure 2:
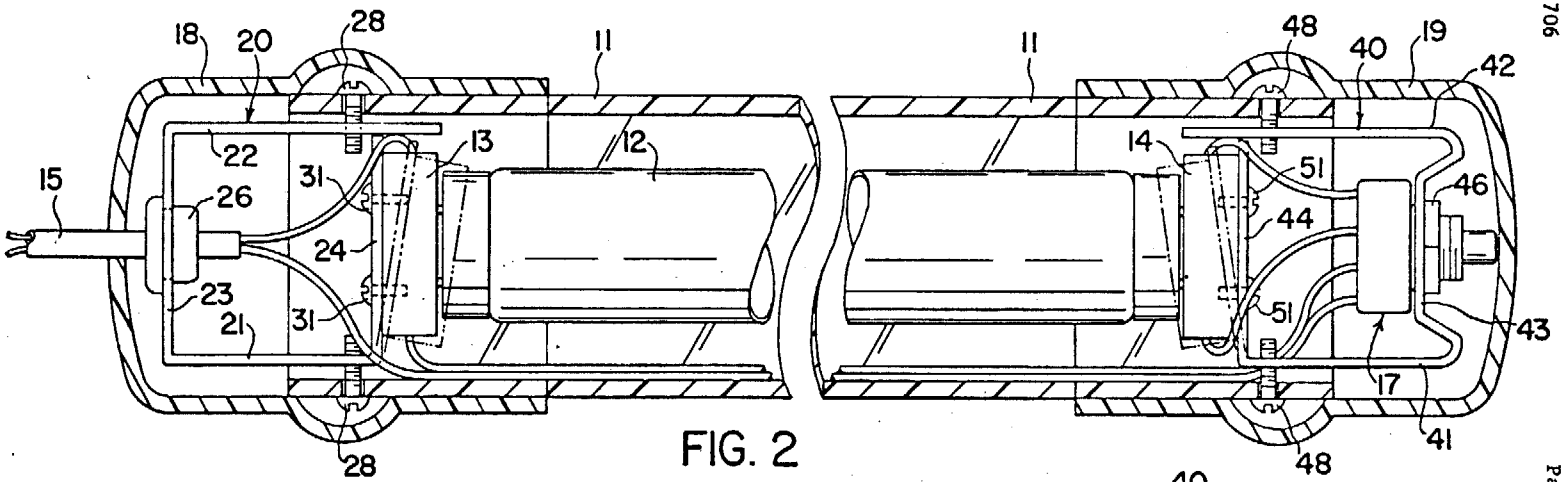

Referring more particularly to the drawings, there is shown a portable fluorescent light embodying the invention and comprising a transparent tubular housing 11, a fluorescent lamp, for example, of 17-inch length, located in the tubular housing 11, two sockets 13 and 14 to which the ends of the fluorescent lamp 12 are connected in the conventional manner, a power cord 15 and a ballast 16. A switch 17 is mounted at the right-hand end of the unit as illustrated in FIG. 2 and a pair of plastic covers 18 and 19 are placed over each end of the housing 11.

In accordance with the invention, there are provided two socket supports 20 and 40 for supporting the respective sockets and for mounting all the respective parts to the tubular housing 11. The brackets are both of very similar construction, but are of slightly different form and will be described separately. Each bracket is formed of an elongated strip of sheet metal which is bent into a four-legged, generally rectangular form.

Figure 3:
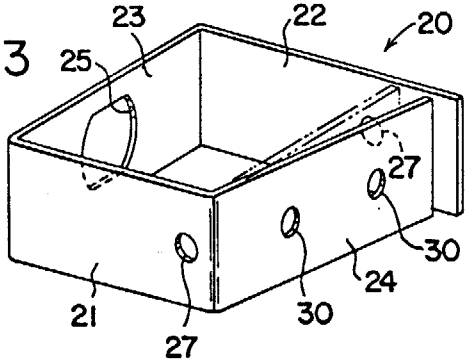
FIG. 3 is a perspective view of one of the socket supports of the lamp of FIGS. 1 and 2 and which embodies the construction of the invention.

The bracket 20 has a pair of parallel side legs 21 and 22, an outer end leg 23 connecting the two side legs 21 and 22, and a flexible inner end leg 24 which is connected only to the leg 21. The leg 24 is adapted to flex between a relaxed position illustrated in solid lines in FIG. 3 and in dashed lines in FIG. 2 and an inwardly flexed operating position illustrated in dashed lines in FIG. 3 and in solid lines in FIG. 2.

The outer end leg 23 has a hole 25 formed therein and which receives a conventional plastic grommet 26 which serves to secure and protect the power cord 15 in the conventional manner. The side legs 21 and 22 each have a threaded hole 27 that receives a screw 28 extending through a matching hole at the end of the tubular housing 11 and into the respective holes 27 to hold the bracket 20 in position. The leg 24 has a pair of holes 30 through which screws 31 extend to connect the socket 13 thereto.

Figure 4:
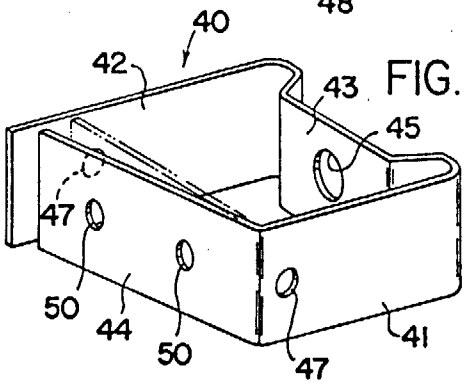
FIG. 4 is a perspective view similar to FIG. 3 illustrating the other socket support of the portable fluorescent light of FIGS. 1 and 2 and which also embodies the invention.

The socket support 40 functions in the same manner as the socket support 20, but has a slightly different shape. It has a pair of parallel side legs 41, an irregularly shaped outer end leg 43 connecting the side legs 41 and 42 and a flexible inner end leg 44 connected only to the end leg 41. The inner end leg 44 is adapted to flex between an inwardly extending relaxed position shown in dashed lines in FIG. 2 and in solid lines in FIG. 4, and a flexed position generally perpendicular to the side legs 41 and 42 as illustrated in solid lines in FIG. 2 and in dashed lines in FIG. 4. The outer end leg 43 has a circular opening 45 formed therein and adapted to receive the threaded mounting shaft of a standard push-button-type switch 17, the switch being secured by a nut 46 in the conventional manner. The parallel side legs 41 and 42 each have a threaded hole 47 that receives threaded fasteners 48 that extend through matching holes in the respective end of the tubular housing 11. The flexible inner end leg 44 has a pair of holes 50 through which screws 51 are inserted to secure the respective socket 14 to the leg 44.

In the assembly of the unit, the switch 17, sockets 13 and 14 and socket supports 20 and 40 are all assembled together and then inserted in the tubular housing 11. The screws 28 and 48, respectively, are then tightened down in the respective holes in the respective socket supports 20 and 40 to secure the assembly in position. It will be apparent that after the assembly is so secured in the housing, the respective reflexible inner end legs 24 and 44 will be flexed to the positions shown in solid lines in FIG. 2 and in dashed lines in FIGS. 3 and 4 to apply the holding force against the fluorescent lamp 12 to tightly retain the lamp in position. Also the flexible inner end legs are capable of additional flexing to accommodate thermal expansion of the tubular housing due to heat generated by the lamp 12 and due to operation under varying environmental temperatures.

While the invention has been shown and described with respect to a specific embodiment thereof, it will be apparent to those skilled in the art that other variations, modifications of the specific form herein shown and described may be used without departing from the spirit and scope of the invention. Accordingly, the patent is not to be limited in scope and effect to the specific embodiment herein shown and described, nor in any other way that is inconsistent with the extent to which the progress in the art has been advanced by the invention.

I claim:

1. In a portable fluorescent light comprising an elongated transparent tubular housing subject to elongation due to thermal expansion, a fluorescent lamp positioned in said housing, and electrical circuit means, including two fluorescent lamp sockets, for energizing said lamp, the improvement which comprises:

a pair of socket supports for mounting said sockets to said housing, each socket support comprising an elongated strip of metal bent into a four-legged, generally rectangular shape with two parallel side legs connected at opposed locations to said housing, an outer leg connected between said side legs and a flexible resilient inner leg that supports the respective socket, said inner leg being connected to one of said side legs and being adapted to flex in a direction parallel to the axis of said fluorescent lamp between an inwardly extending relaxed position and a flexed retracted operating position generally perpendicular to said side legs, whereby when said lamp is connected to said sockets and positioned in said tube, said respective inner legs are flexed in a direction parallel to the axis of said fluorescent lamp to their operating position to apply a tight holding force to said lamp and to accommodate elongation due to thermal expansion of said housing to which the socket supports are attached.

* * * * *

UNITED STATES PATENT AND TRADEMARK OFFICE

CERTIFICATE OF CORRECTION

PATENT NO. : 4,092,706

DATED : May 30, 1978

INVENTOR(S) : Gary W. Vest

It is certified that error appears in the above-identified patent and that said Letters Patent are hereby corrected as shown below:

Cancel the sheet of drawing and substitute the attached sheet comprising figures 1 thru 4.

Signed and Sealed this

*Seventeenth* Day of *July 1979*

[SEAL]

*Attest:*

*Attesting Officer*

LUTRELLE F. PARKER

*Acting Commissioner of Patents and Trademarks*